US006572056B2

(12) United States Patent
Berry et al.

(10) Patent No.: US 6,572,056 B2
(45) Date of Patent: Jun. 3, 2003

(54) METHOD AND APPARATUS FOR UNIFORM TIME WARNING OF RAILROAD TRAINS

(75) Inventors: James Arthur Berry, Fairport, NY (US); Naor Wallach, Pittsford, NY (US)

(73) Assignee: Alstom Signaling, Inc., Rochester, NY (US)

( * ) Notice: Subject to any disclaimer, the term of this patent is extended or adjusted under 35 U.S.C. 154(b) by 0 days.

(21) Appl. No.: 10/027,008

(22) Filed: Dec. 20, 2001

(65) Prior Publication Data

US 2002/0096605 A1 Jul. 25, 2002

Related U.S. Application Data

(60) Provisional application No. 60/263,440, filed on Jan. 23, 2001.

(51) Int. Cl.[7] ..... G02B 6/34

(52) U.S. Cl. ..... 246/115

(58) Field of Search ..... 246/34 A, 117, 246/115, 111, 114 R, 112, 113, 122 R, 124, 125, 126, 127, 160, 174, 182 A, 167 A, 294, 246, 128, 270 R, 292, 293, 295, 473.1

(56) References Cited

U.S. PATENT DOCUMENTS 3,610,920 A 10/1971 Frielinghaus
4,120,471 A 10/1978 Auer, Jr.
4,172,576 A 10/1979 Svet, Jr. et al.
5,340,062 A * 8/1994 Heggestad ..... 246/167 R
5,554,982 A * 9/1996 Shirkey et al. ..... 246/122 R
5,699,986 A * 12/1997 Welk ..... 246/122 R
5,735,492 A * 4/1998 Pace ..... 246/125
5,864,304 A * 1/1999 Gerszberg et al. ..... 246/122 R
5,890,682 A * 4/1999 Welk ..... 246/122 R
5,893,043 A * 4/1999 Moehlenbrink et al. 246/182 C
5,950,966 A * 9/1999 Hungate et al. ..... 246/167 R
6,179,252 B1 * 1/2001 Roop et al. ..... 246/122 R
6,218,961 B1 * 4/2001 Gross et al. ..... 246/122 R
6,241,197 B1 * 6/2001 Harland ..... 246/125

* cited by examiner

*Primary Examiner*—Mark T. Le
(74) *Attorney, Agent, or Firm*—Ohlandt, Greeley, Ruggiero & Perle, L.L.P.

(57) ABSTRACT

A system for controlling a train's approach on a right-of-way to a grade crossing such that a uniform warning time is ensured comprising: a communication based train control scheme including a computer situated on the train; a device for detecting the presence of the train at a first control point on the right-of-way and for determining the train's speed thereat; a device for activating the gate at the grade crossing responsive to the train being at a second control point on the right-of-way wherein the second control point is based on the determined speed such that a uniform warning time is provided.

7 Claims, 7 Drawing Sheets

CBTC CONTROL APPLICATION

METHOD AND APPARATUS FOR UNIFORM TIME WARNING OF RAILROAD TRAINS

This Application claims the benefit of Provisional Application No. 60/263,440, filed Jan. 23, 2001.

BACKGROUND OF THE INVENTION

1. Field of the Invention

The present invention relates to controlling the behavior of a train and, in particular, to controlling a train's approach to grade crossings.

2. Description of the Prior Art

Grade crossing mechanisms are activated by approach circuits placed on the railroad track. These approach circuits are placed at a particular distance from the grade crossing, such that a train moving at a certain speed will activate the gates at the grade crossing at a pre-defined amount of time before the train arrives at the crossing. Unfortunately, present systems are not known to accommodate trains that are traveling at speeds that vary from that for which the approach circuit placement was designed in electrified territory where grade crossing predictors cannot be used. Therefore, a train that is traveling at half the design speed will cause the crossing gates to be activated (and traffic blocked) for twice as long as originally designed. Correspondingly, a train traveling at higher speeds will provide proportionately less warning time than the placement design specifications.

This is shown graphically in FIG. 1. In this example, the approach circuits are placed approximately 4,107 ft. in front of the grade crossing. The time between the train arriving at the approach circuit and the train arriving at the grade crossing varies between the desired 35 seconds for a train traveling at 80 MPH, and as much as 560 seconds for a train traveling at 5 MPH. The algorithm for this situation is represented in the flow chart shown in FIG. 2.

As demonstrated in this example, current grade crossing activation systems are relatively inflexible which causes significant variability in the amount of warning they provide to the public. This has safety implications in that inconsistent and/or relatively long warning times may foster undesirable behavior in certain members of the public. These certain members of the public may make assumptions about the length of time it may take the train to reach the crossing and may attempt to drive around the crossing gates, or engage in other unsafe behavior. This is a particular problem when, as noted before, the train may be moving at a very slow speed of 5 MPH.

It is an advantage of the present invention to control train operations in order to achieve a more efficient operation of an approached grade crossing. Currently, there is wide variability in the operations of grade crossing gates due to speed fluctuations and other operating characteristics of the approaching train, vehicles at the crossing gate and characteristics of the highway and rail interface. The present invention as described herein leads to significantly more "efficient" operation of the grade crossing where "efficiency" is defined as how close the operations come to a uniform and standard time from warning to train traversal of the crossing (also known as UTW for Uniform Time Warning). The present invention utilizes Communication Based Train Control (CBTC), a device which can be appreciated by reference to the following publication: Communications among components of the rail system, including the train and intelligent grade crossing controllers, as well as some level of train control have been combined in an innovative way by the present inventors to achieve efficient operations at the crossing gate.

With the advent of CBTC systems it is possible to be more intelligent in the control of grade crossing systems. This improvement results in a more flexible system that accommodates the variations in train speed while maintaining a consistent warning time to the public. With the application of the present invention to CBTC systems it is possible to approach consistent warning times regardless of train operations, e.g., even if the train speed should tend to increase radically.

Present CBTC systems are not sufficient in and of themselves because they are not known to control train operations. The present invention shows how control of train operations in combination with a CBTC system provides a significant advantage in efficiently controlling grade crossing gates. The present invention is distinguished over the prior art at least because of its ability to significantly improve the efficiency of grade crossing operations.

According to the present invention, the amount of time between when the crossing gates are activated and when the train is actually at the crossing is more consistent. As the public becomes aware of this consistency, the public may be more likely to wait for a train to pass and avoid unsafe behavior, such as attempting to drive around the crossing gates.

As used in this description, an example of an ideal uniform time warning (UTW) is 35 seconds, but in general UTW is a variable that can be set to any value.

A graph showing the ideal warning distance for all train speeds between 0 and 80 miles per hour is shown in FIG. 3. The figure shows that regardless of the speed of the train, it would provide 35 seconds of warning time at the grade crossing. However, this is not achieved in practice. With current CBTC systems, the train can communicate location and speed information to the wayside equipment. This establishes the basis for the necessary calculations, but other factors may also need to be considered.

Current train control systems are not known to constrain the speed or acceleration of a train approaching a grade crossing. For example, a locomotive engineer may begin a rapid acceleration after activating the approach circuit for a particular grade crossing. As another example, if the train comes in to the area depicted in FIG. 3 at 5 MPH, it may accelerate from 5 MPH to 80 MPH at any point. In the worst possible condition, it could start accelerating when it is 260 ft. away from the crossing, just as an approach circuit activates the crossing gate. This would drastically reduce the warning time to well below the desired 35 seconds. In fact, the warning would be only about 9 seconds. FIG. 4 shows this example.

To eliminate the possibility of such a problem, the system could be designed such that the grade crossing gates are activated well before the efficient frontier. In FIG. 5 the thicker line represents the time when the grade crossing gates would need to be activated to assure a minimum of 35 seconds of warning time. However, this in turn translates to only a small improvement over the current art. Specifically, a train that enters from the right, travelling at 5 MPH would cause the crossing gates to go down about 6 minutes before the train arrives at the crossing—clearly this is not efficient operations.

The present invention is also advantageous in that it provides for a more consistent operation of the grade crossings that would be visible to the public, resulting in a public good, as more consistent and efficient grade crossing gate operations enhance the safety of the traveling public at such crossings.

SUMMARY OF THE INVENTION

The present invention is directed toward a system for controlling the movement of a train as it approaches a grade crossing to achieve a uniform time period from activation of the crossing gates to the traversal of the crossing by the train. The present invention continuously monitors the train's movement as it approaches the crossing and at a particular point determines the train's velocity and a time to activate the gates that satisfies the UTW. At this point the system determines an upper velocity limit that, if exceeded, will reduce the time to activate the gates below the UTW. The system continues to monitor the train's velocity during the train's approach. If the train's velocity remains constant, train operations are unaffected. If the train attempts to accelerate, the train's velocity is restricted to conform to the UTW. But, if a change of velocity is detected during the approach toward the crossing gates, the gates are immediately activated and a top velocity is enforced on the train. This combination of means ensures that the gates are down for the minimum time of 35 seconds and that the gates are consistently activated The foregoing and still further objects and advantages of the present invention will be more apparent from the following detailed explanation of the preferred embodiments of the invention in connection with the accompanying drawing.

DETAILED DESCRIPTION OF THE INVENTION

The objects and the advantages of the invention are realized by methods and apparatus in accordance with embodiments of this invention.

Figure 6:
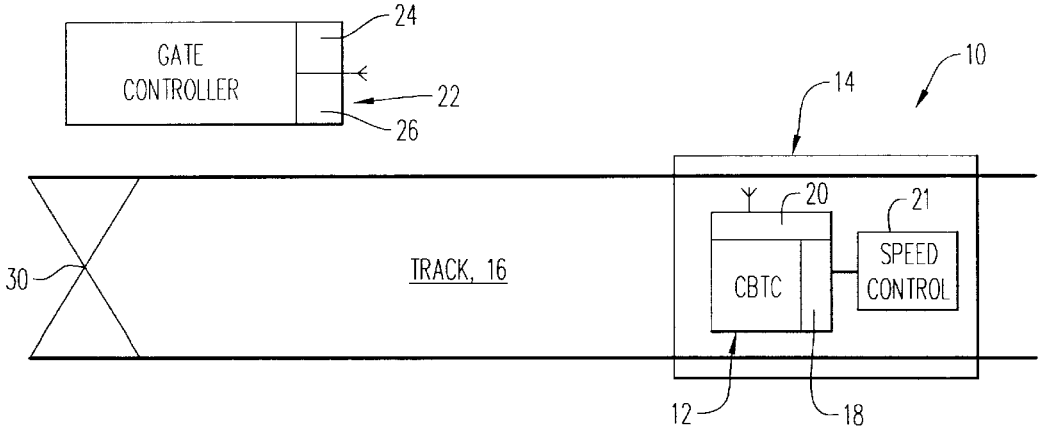
FIG. 6 is a block diagram of the system of the present invention for providing uniform time warning.

Referring now to FIG. 6 of the drawings, there will be seen a block diagram of a uniform time warning system 10 in which a CBTC scheme or sub-system 12, already noted and referenced, would be utilized.

Figure 1:
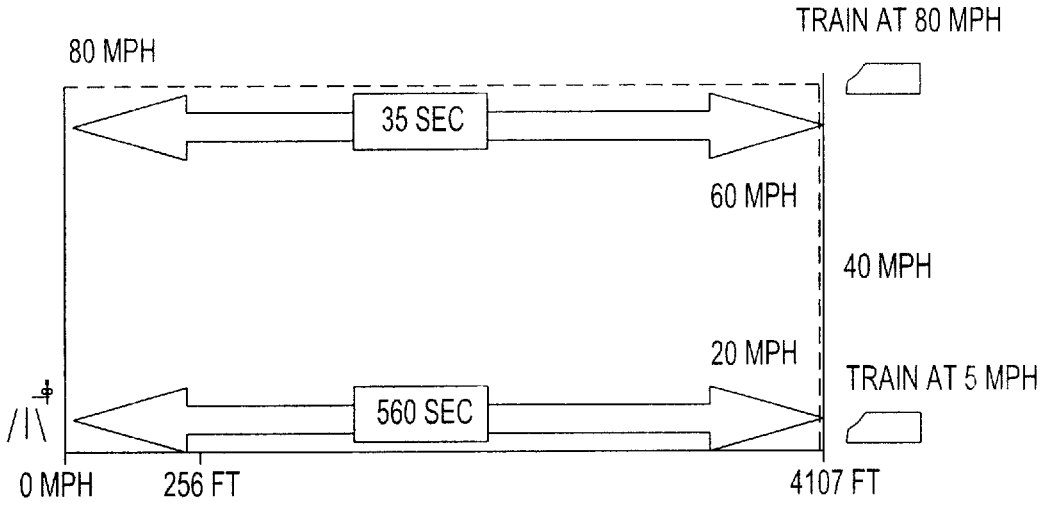
Fig. 1 (Prior Art)
FIG. 1 is a diagram depicting train speed versus warning time.
Figure 2:
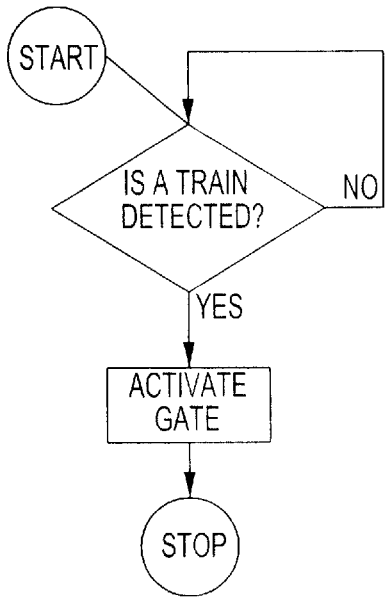
Fig. 2 (Prior Art)
FIG. 2 is a logic diagram for prior art train detection and gate activation.
Figure 3:
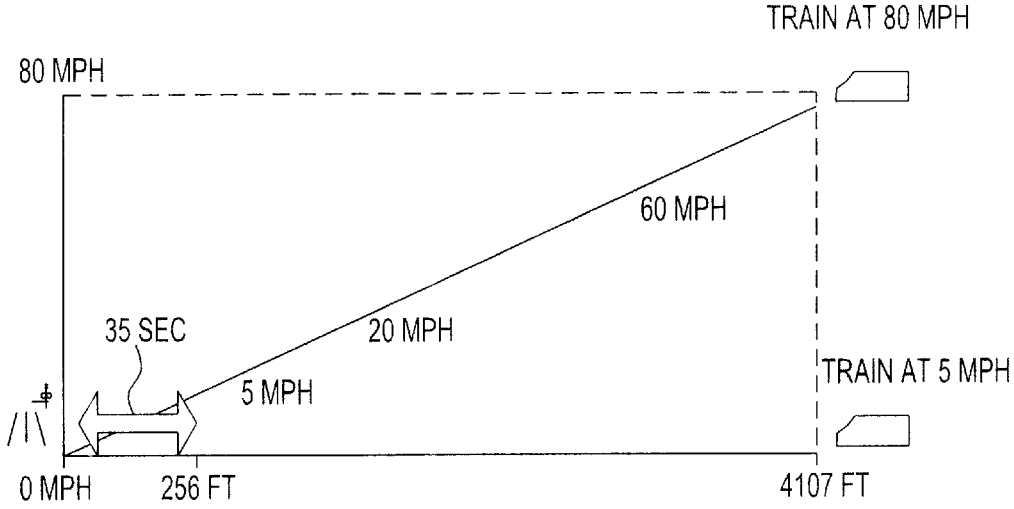
FIG. 3 is a graph of ideal warning distances versus train speed.
Figure 4:
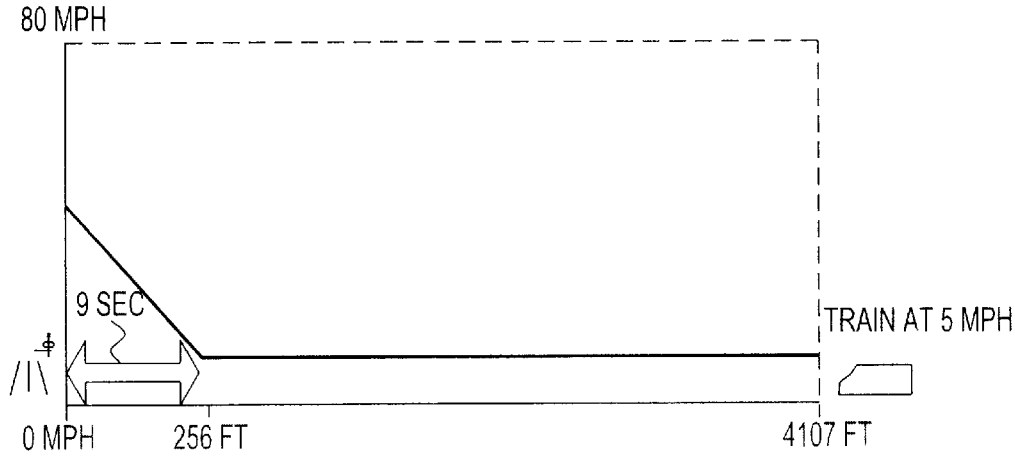
Fig. 4 (Prior Art)
FIG. 4 is a graph depicting the impact on the warning time when a train accelerates in the vicinity of the approach circuit and continues to accelerate.
Figure 5:
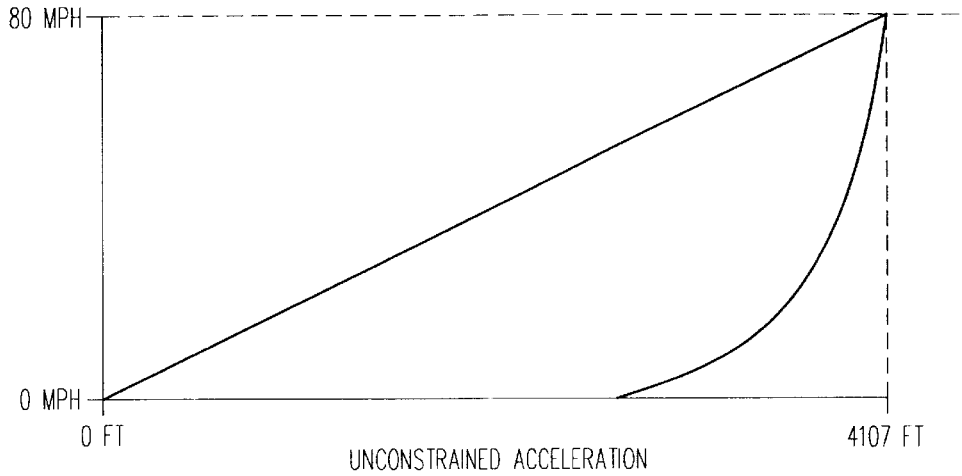
FIG. 5 is a graph depicting the impact of unconstrained acceleration on the warning time by charting distance versus acceleration.

In accordance with a broad feature of the present invention, a CBTC modified to serve as a control/signaling scheme 12 is disposed, as seen in FIG. 5, on the train 14 which travels along track 16. The modification of the CBTC includes a suitably programmed computer 18 and a wireless transmitter 20. The CBTC is coupled to a speed control device 21 to be described. A gate controller 22 for controlling movement of a grade crossing gate 30 is seen, including a receiver 24 for receiving control signals from transmitter 20, and a computer 26.

Figure 7:
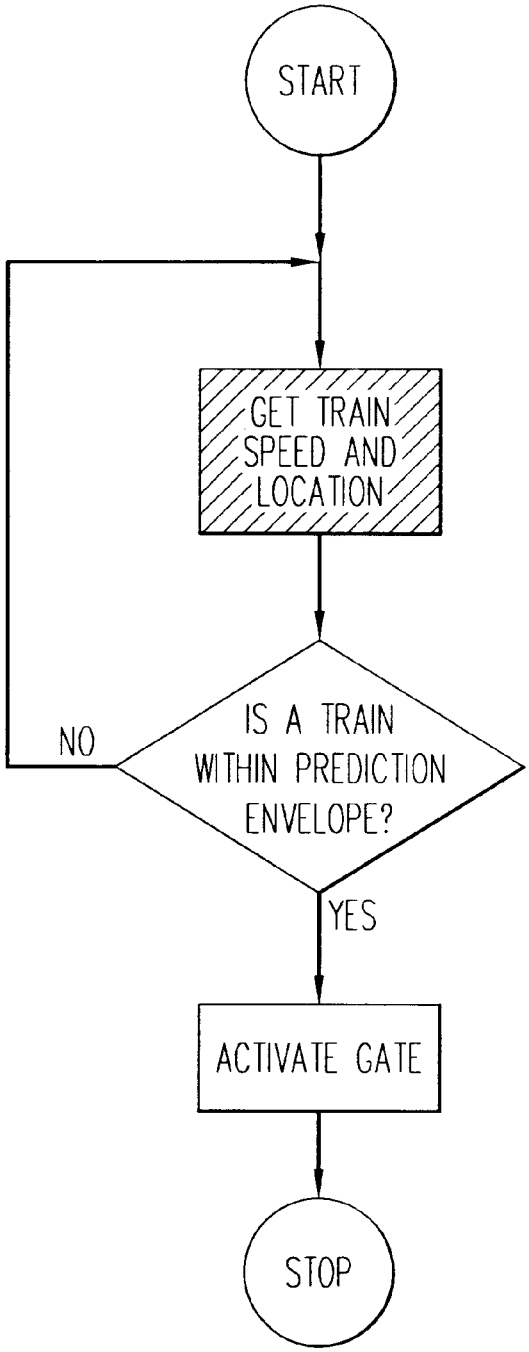
FIG. 7 is a logic diagram of a communication based train control application.

FIG. 7 provides a flow diagram that depicts how the CBTC scheme 12 is utilized in activating the grade crossing equipment.

We define an operational profile of the train as having three possible states:

the train's entrance velocity, a acceleration period from entrance velocity to final velocity, and the train's final velocity.

The train can be in each of these states for an arbitrary amount of time. A variable "t" may be associated with each of these states that represent the amount of time that the train is in that state. For example, $t_1$ could be the amount of time that the train stays at its entrance velocity, $t_2$ could represent an acceleration period from entrance velocity to final velocity, and so forth.

The total amount of warning time that we wish to provide can be represented as the train speed profile $t=t_1+t_2+t_3$.

Figure 8:
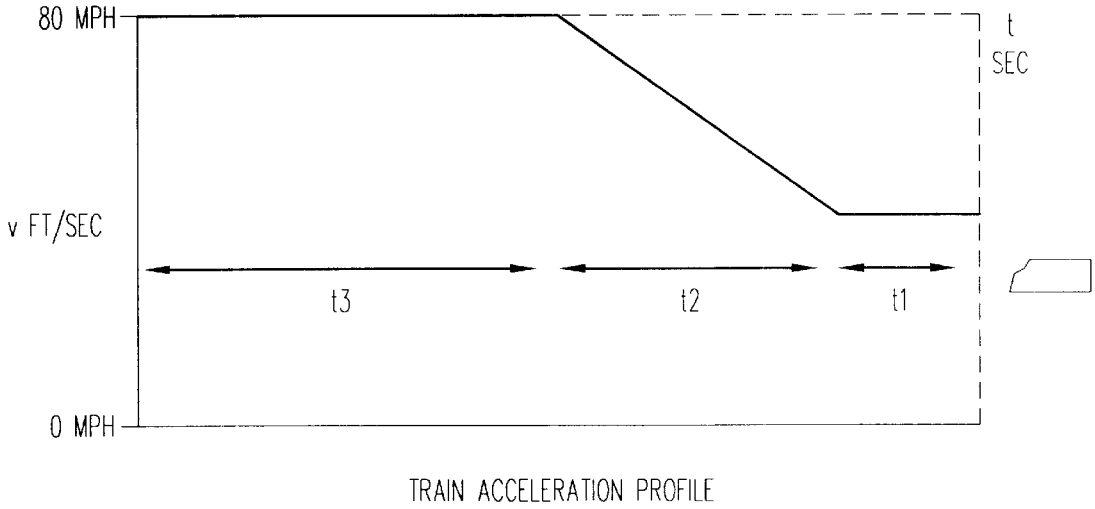
FIG. 8 is a graph of a train acceleration profile.
Figure 9:
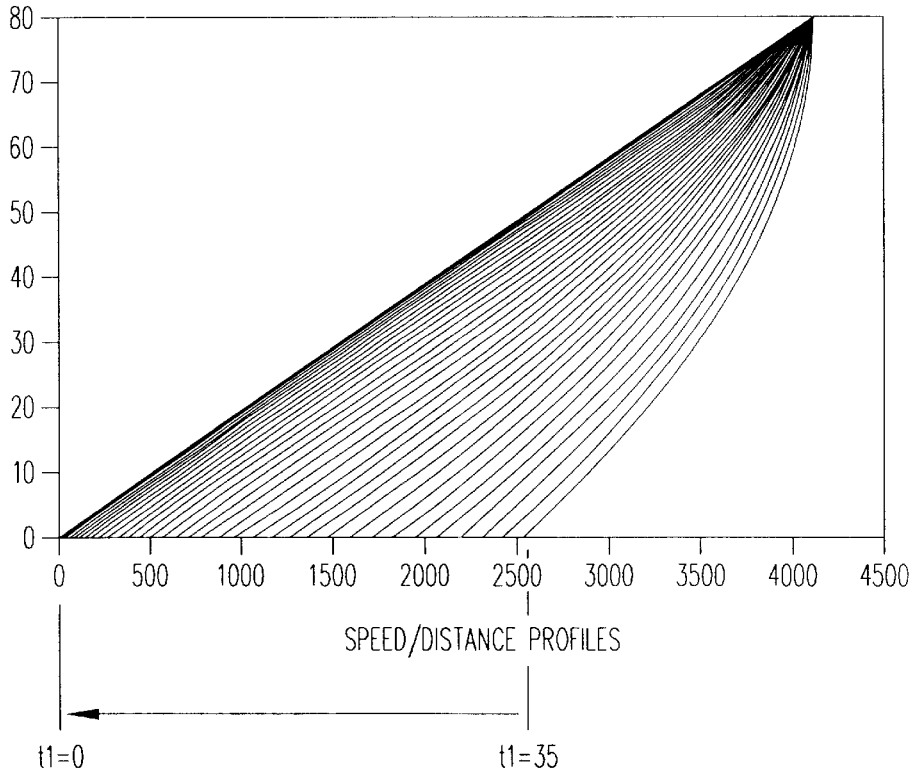
FIG. 9 is a graph depicting various train speed/distance profiles.

The train speed profile can be shown as in FIG. 8. Applying this profile to trains that enter at various velocities into an area on the right of any preceding grade crossing results in an analysis of the different profiles that would need to be used to achieve a warning time of 35 seconds at the grade crossing. FIG. 9 represents those curves for the case discussed.

As an example, one way of considering this information is to envision a train coming in from the right of the graph, moving at a specified velocity (say 15 MPH). At 3074 feet away from the crossing, the grade crossing gates should be activated to accommodate the unconstrained acceleration case. But, should the train remain at 15 MPH, the crossing gates would be activated 140 seconds before the train actually arrived at the crossing—an excessively long time.

Accordingly, to overcome such a drawback, a specific feature of the present invention provides that the behavior of the train is monitored using moving averages. As long as the train remains at 15 MPH speed, there is no need to activate the crossing gates until the train is 770 feet away from the crossing. If an acceleration in the train's speed is detected, a top velocity could be immediately enforced on the train such that the UTW would not be violated. This would ensure that the crossing gates are down for the minimum of 35 seconds time before a train's arrival, and that the crossing gates are consistently activated.

Figure 10:
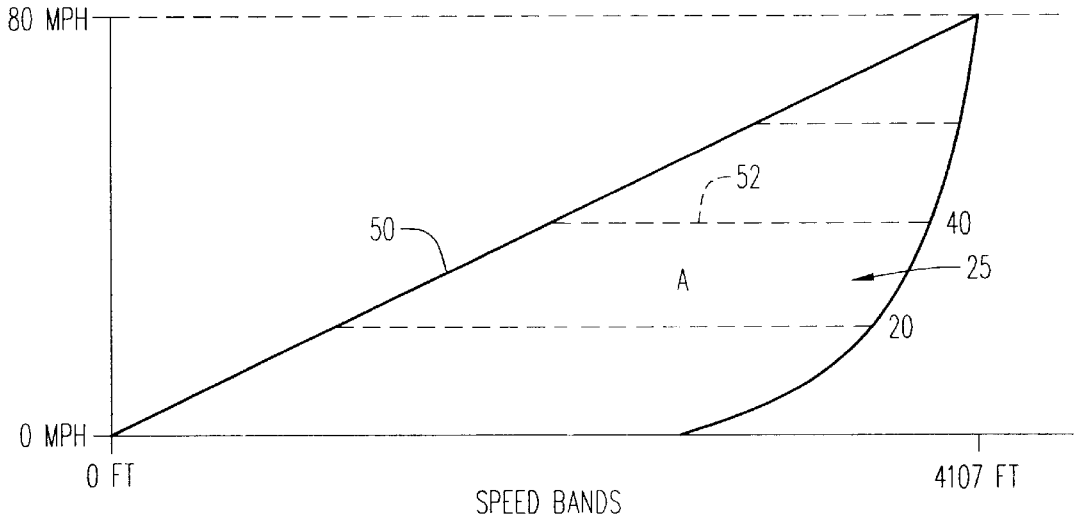
FIG. 10 is a graph of an example of speed bands which are used to control a train according to the present invention.

FIG. 10 represents an example of this scheme where a series of top velocities define bands on a graph, called speed bands. It should be noted that any number of speed bands may be implemented as part of this invention. The number of speed bands may be determined at the time of implementation. Typical examples of numbers of speed bands include between 5 and 25 speed bands in a particular application. For ease of explanation, FIG. 10 shows 3 speed bands.

In the explanations above and below there is an emphasis on detecting train accelerations. As mentioned above, an accelerating train whose acceleration is not compensated for can drastically reduce the warning time at the grade crossing, thus violating the minimum warning time required at the grade crossing. This condition is therefore diligently guarded against.

In another embodiment there may be no equivalent compensation for a decelerating train. A lack of such compensation may make a system somewhat less efficient but does not compromise safety.

Figure 11:
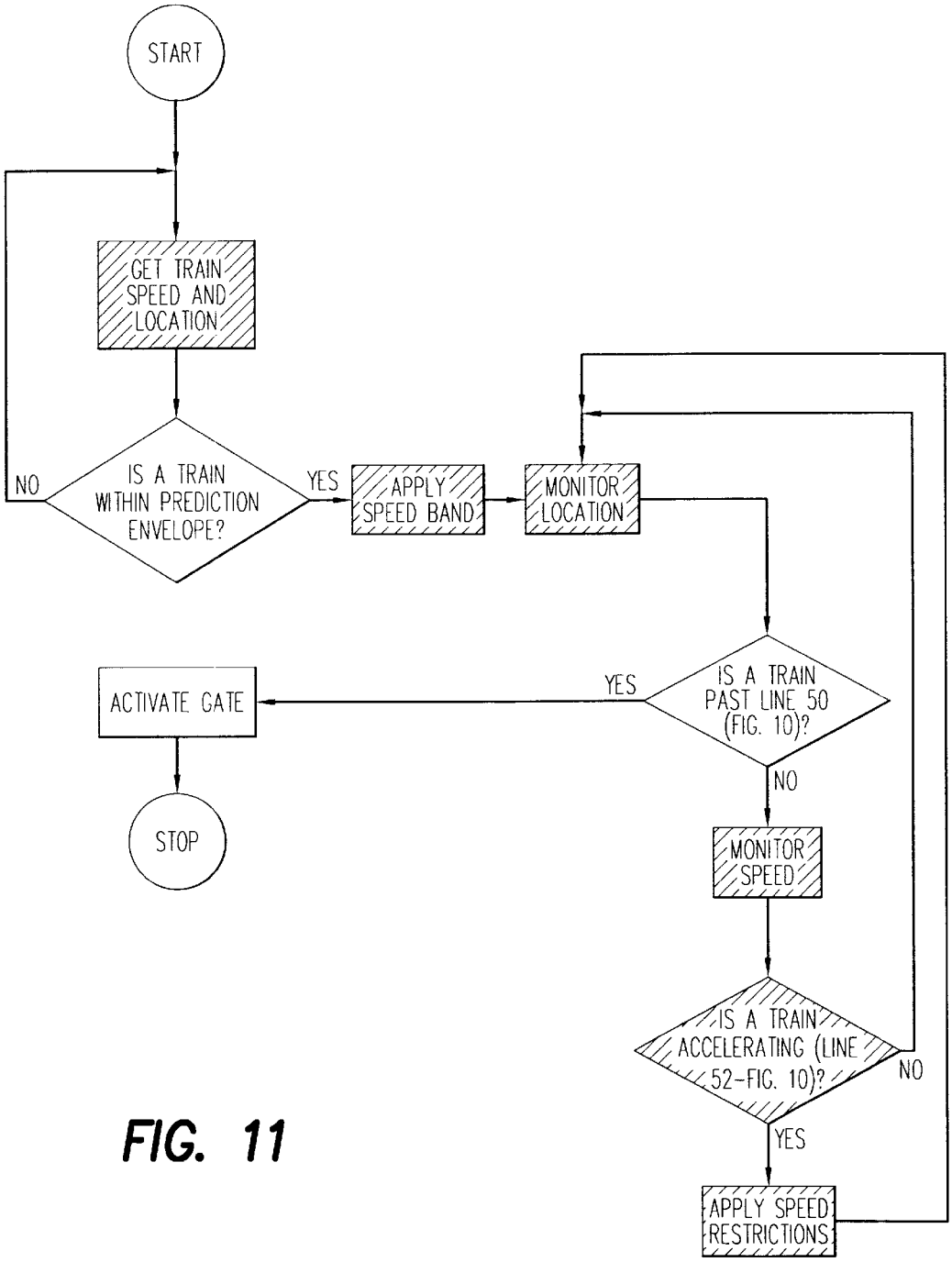
FIG. 11 is a logic diagram of a communication based train control application in accordance with the present invention.

FIG. 11 provides the flow chart of an application in accordance with the invention. Referring now to FIGS. 10 and 11 together, as the train enters the territory of interest (from the right in FIG. 10), the system continuously monitors its location and velocity. Once the system determines that the train has entered the prediction envelope, it applies the speed band appropriate to its entrance velocity. This speed band determines an upper speed that the train is allowed to operate in once it is within the prediction envelope.

The system continues to monitor the train's location and speed. As long as the train's location remains within the prediction envelope (i.e., does not reach the UTW line 50 or exceed the speed band line 52 for a given velocity, seen in FIG. 10 (as area A) the system does nothing but monitor. As long as the train's velocity remains relatively constant, the system does not affect the train's operations. Once a change in velocity is observed, the train applies the speed restriction. In other words, the system would not allow the train to continue accelerating—by modifying the train's operator display and applying the brakes as necessary to constrain the train's velocity.

Once the train has reached the UTW line, the crossing gates are activated. The system continues to monitor the speed of the train and to regulate the maximum speed that it will allow the train to travel at. This is done to eliminate the possibility of the train accelerating in its approach to the grade crossing in such a way as to compromise the safety of the system. Once the train has crossed the grade crossing area, all speed restrictions are lifted and the system reverts back to its normal mode of operations (which may contain other speed restrictions in it).

Thus, while the invention has been particularly shown and described with respect to preferred embodiments thereof, it will be understood by those skilled in the art that changes in form and details may be made therein without departing from the scope and spirit of the invention.

What is claimed is:

1. A system for controlling a train's approach on a right-of-way to a grade crossing, having a gate, such that a uniform time warning is ensured comprising:

a communication based train control scheme, including a computer, situated on the train, the scheme providing a uniform time line;

means situated at a wayside location for detecting the presence of a train at a first control point on the right-of-way, and for determining the train's speed thereat;

means for detecting any acceleration in train speed at variable locations of the train beyond the first control point, including means, responsive to detecting the acceleration for controlling the train speed in selected bands to preclude violating minimum warning times required at the grade crossing.

2. A system, as defined in claim 1, further comprising:

means for applying a selected speed band based on the train's entrance speed at the first control point;

wherein the means for detecting any acceleration includes means for continuously monitoring the location an speed of the train as it approaches a gate crossing;

means for determining whether the train is within the uniform time warning line;

means for activating the gate at a grade crossing if the train is within the uniform time warning line.

3. A system, as defined in claim 1, further including:

means responsive to the means for controlling train speed for automatically adjusting the location of the point on the right-of-way at which the gate is activated by the control scheme based on an enforced top speed.

4. A method of controlling a train's approach on a right-of-way to a grade crossing, having a gate, such that a uniform time warning is ensured comprising the steps of:

detecting the presence of the train at a first control point on the right-of-way with a communication based control scheme;

including a computer situated on the train, the scheme providing a uniform time warning line;

determining the train's speed at the first control point;

activating the gate at the ate crossing when the train is at a second control point on the right-of-way, wherein the second control point is selectively based on the determined speed such that a uniform time warning is provided.

5. A method, as defined in claim 4, further comprising the steps of:

detecting any acceleration in train speed at variable locations of the train beyond the first control point, and controlling the train's speed in selected bands to preclude violating minimum warning times required at the gate crossing.

6. A method, as defined in claim 5, further comprising the steps of:

applying a selected speed based based on the train's entrance speed at the first control point;

wherein the means for detecting any acceleration in train speed includes means for continuously monitoring the location and speed of the train as it approaches a gate crossing;

means for determining whether the train is within the uniform time warning line, and means for activating the gate at a grade crossing if the train is within the uniform time warning line.

7. A method, as defined in claim 5, further comprising the steps of:

automatically adjusting the location of the second control point on the right-of-way at which the gate is activated by the control scheme based on an enforced top speed.

* * * * *